US011383124B2

(12) United States Patent
McGovern

(10) Patent No.: US 11,383,124 B2
(45) Date of Patent: Jul. 12, 2022

(54) FITNESS DEVICE WITH CURVED SLIDING OR ROLLING SURFACE COVERING FOREARMS

(71) Applicant: AB SHIELD LLC, Durham, NC (US)

(72) Inventor: Trevor Thomas McGovern, Durham, NC (US)

(73) Assignee: AB SHIELD LLC, Durham, NC (US)

( * ) Notice: Subject to any disclaimer, the term of this patent is extended or adjusted under 35 U.S.C. 154(b) by 2 days.

(21) Appl. No.: 17/003,654

(22) Filed: Aug. 26, 2020

(65) Prior Publication Data

US 2021/0252329 A1 Aug. 19, 2021

Related U.S. Application Data

(60) Provisional application No. 62/922,787, filed on Aug. 27, 2019.

(51) Int. Cl.

| | |
|---|---|
| ***A63B 21/00*** | (2006.01) |
| ***A63B 23/12*** | (2006.01) |
| ***A63B 21/002*** | (2006.01) |
| ***A63B 21/068*** | (2006.01) |
| ***A63B 22/20*** | (2006.01) |

(52) U.S. Cl.

CPC ..... *A63B 21/4035* (2015.10); *A63B 21/0023* (2013.01); *A63B 21/068* (2013.01); *A63B 21/4033* (2015.10); *A63B 22/20* (2013.01); *A63B 23/1236* (2013.01)

(58) Field of Classification Search

CPC ..... A63B 21/0005; A63B 21/00054; A63B 21/072–075; A63B 21/4017–4021; A63B 21/0023; A63B 21/068; A63B 23/02–0227; A63B 23/1236; A63B 2208/0295; A63B 69/004; A63B 71/14–148; A63B 2069/044; A63B 2244/10–106

See application file for complete search history.

(56) References Cited

U.S. PATENT DOCUMENTS 3,185,476 A * 5/1965 Fechner ..... A63B 43/02 473/596
3,347,240 A * 10/1967 Rigler ..... A63B 23/16 607/77
3,855,633 A * 12/1974 Rhee ..... A63B 71/145 2/18

(Continued)

*Primary Examiner* — Garrett K Atkinson
*Assistant Examiner* — Kathleen M Fisk
(74) *Attorney, Agent, or Firm* — Sofer & Haroun, LLP

(57) ABSTRACT

An exercise device is provided for use in connection with at least one bodyweight exercise. The device has a grip handle and a forearm support at substantially a perpendicular arrangement with the grip handle, allowing a user to grasp the grip handle and simultaneously place a forearm into the device. A curved finger shield region covers the grip handle and a curved forearm region covers the forearm support. The curved finger shield region and the curved forearm region form a contiguous curved surface with a substantially perpendicular transition between the two, such that a user grasping the grip handle and simultaneously resting their forearm on the forearm region, can support at least a portion of their body weight on either one of the curved finger shield regions or the curved forearm region.

17 Claims, 15 Drawing Sheets

(56) References Cited

U.S. PATENT DOCUMENTS

| | | | | | |
|---|---|---|---|---|---|
| 3,990,699 | A * | 11/1976 | Urmston | A63B 60/40 | 473/567 |
| 4,688,789 | A * | 8/1987 | Alter | A61H 3/02 | 135/71 |
| 4,942,624 | A * | 7/1990 | Cho | A63B 71/08 | 2/16 |
| 5,911,197 | A * | 6/1999 | Schmid | A41D 13/08 | 119/712 |
| 5,953,752 | A * | 9/1999 | Jones | A63B 71/14 | 2/16 |
| 7,972,251 | B2 * | 7/2011 | Peddar | A63B 22/20 | 482/132 |
| 9,079,092 | B2 * | 7/2015 | Stack | A63B 71/145 | |
| 9,592,419 | B1 * | 3/2017 | Cuffe | A63B 21/4035 | |
| 2015/0013041 | A1 * | 1/2015 | McBride | A63B 71/145 | 2/18 |
| 2015/0133275 | A1 * | 5/2015 | Johnson | A63B 21/4035 | 482/108 |

* cited by examiner 10
12
14
16
20
30

FITNESS DEVICE WITH CURVED SLIDING OR ROLLING SURFACE COVERING FOREARMS

RELATED APPLICATION

This application claims the benefit of priority from U.S. Provisional Application No. 62/922,787, filed on Aug. 27, 2019, the entirety of which is incorporated by reference.

FIELD OF INVENTION

The present arrangement is directed to fitness equipment. More particularly, the present arrangement is directed to fitness equipment to assist with bodyweight exercises for strengthening the muscles throughout the human body.

DESCRIPTION OF THE RELATED ART

In the field of fitness equipment there are numerous types of devices to assist a user with exercise. Many of the standard fitness devices are large weight transfer machines, as typically found at the gym. Other devices are more basic such as simple weights.

Aside from these typical fitness devices, there is a subclass of devices that are designed to assist a user in a bodyweight exercise. A bodyweight exercise is an exercise that simply utilizes the weight of the body to provide the resistance to the exercise. An example of a bodyweight exercise is a push-up or pull-up.

In the prior art, there is a field of fitness devices that are designed to be used to assist or modify a bodyweight exercise to provide comfort, ease of movement, additional movements, etc., when performing bodyweight exercises. For example, when doing a push-up the normal method is to use the flattened hand. However, an alternative method is to use a closed first which has a slightly different effect on the muscle groups being challenged relative to the basic method, for example, to simultaneously add forearm stress. There are prior art floor pads with grips that allow a user to use the closed first during a push-up without pressing their knuckles into the ground.

Along these lines, there are numerous types of fitness devices to assist a user in bodyweight exercises of varying degrees of complexity and design. However, despite these existing devices, there is no fitness device that offers protection to a user's arms and knuckles when performing transitions between a first bodyweight exercise (that might stress the knuckles) into at least a second bodyweight exercise (that might stress the forearms), and vice versa without changing grips. Further, there is no existing fitness device that allows a user to perform sliding forearm low plank exercises on a curved surface, whether using one arm or two. A curved surface would enable the user to challenge balance according to different degrees of difficulty.

OBJECTS AND SUMMARY

In one embodiment, the present arrangement provides a pair of forearm supports with an encased grip that has a curved outer surface that enable one to transfer from a plank position on their forearms up into a plank position on their knuckles protecting the knuckles and forearms from direct contact with the floor. The ability conveyed to a user by this fitness device, unique to the present arrangement, is to push up with handles from the plank forearms used in the low plank exercise to rolling up onto the knuckles of the curved push-up handle allowing a high plank exercise opportunity for the user.

Such a device provides a frame for one or more arms that consists of both forearm supports and a curved handle which can be used for push-ups that enable this shifting from one plank exercise position to another, all using the same piece of fitness equipment.

In one embodiment, the present handles have a curved surface on each of the two fitness devices (one for each arm or one for each hand, depending on the exercise the user chooses) that challenge the user's ability to enhance the difficulty of attaining desirable balance. Additionally, the curved surface helps recruit more muscles that are used to stabilize the plank position, providing additional exercising opportunities during use.

In one arrangement, the present devices can be used for numerous exercises. The potential list of exercise varieties made available when using the present fitness device is too long to itemize herein. In one example, side plank exercises would be available with this device such that when the user wants, the user turns to a side position (facing a wall or surface by turning onto one's side) and engages in a plank exercise position wherein there are only two points of contact with the supporting surface:

1) the sides of the user's shoes which take on a weight bearing function; and 2) one of the user's forearms which rests upon the supporting surface in such a way as to provide weight bearing support for the user. Furthermore, the list of exercises and variations thereof that can be performed with the present devices could be equally applied to push-ups, in several possible permutations.

In one embodiment, the present device is made of a material that has the capacity to slide smoothly and easily on a supporting surface on a curved bottom, either indoors or outdoors, such as an injection molded polymer or the like. The present fitness device provides the ability to safely and effectively train the muscles of the core, and other muscles of the body, through various exercises, some of them unique to this piece of equipment, including unique variations on the plank exercise.

To this end, an exercise device is provided for use in connection with at least one bodyweight exercise. The device has a grip handle and a forearm support at substantially a perpendicular arrangement with the grip handle, allowing a user to grasp the grip handle and simultaneously place a forearm into the device. It should be noted that the grip handle's attachment to the forearm support could vary in different embodiments from the substantially perpendicular arrangement. It could be placed in a horizontal fashion (180 degrees) or at varying angles providing a sloping arrangement, either titling forwards away from the user or sloping backwards closer to the user. The grip handle could also be sloped toward the middle or away from the middle. In one embodiment, the grip handle could rotate from the vertical position of the hands to the horizontal position of the hands. A curved finger shield region covers the grip handle and a curved forearm region covers the forearm support.

The curved finger shield region and the curved forearm region form a contiguous curved surface with a substantially perpendicular transition between the two, such that a user grasping the grip handle and simultaneously resting their forearm on the forearm region, can support at least a portion of their body weight on either one of the curved finger shield regions or the curved forearm region.

BRIEF DESCRIPTION OF THE DRAWINGS

The present invention can be best understood through the following description and accompanying drawing, wherein.

DETAILED DESCRIPTION

Figure 1:
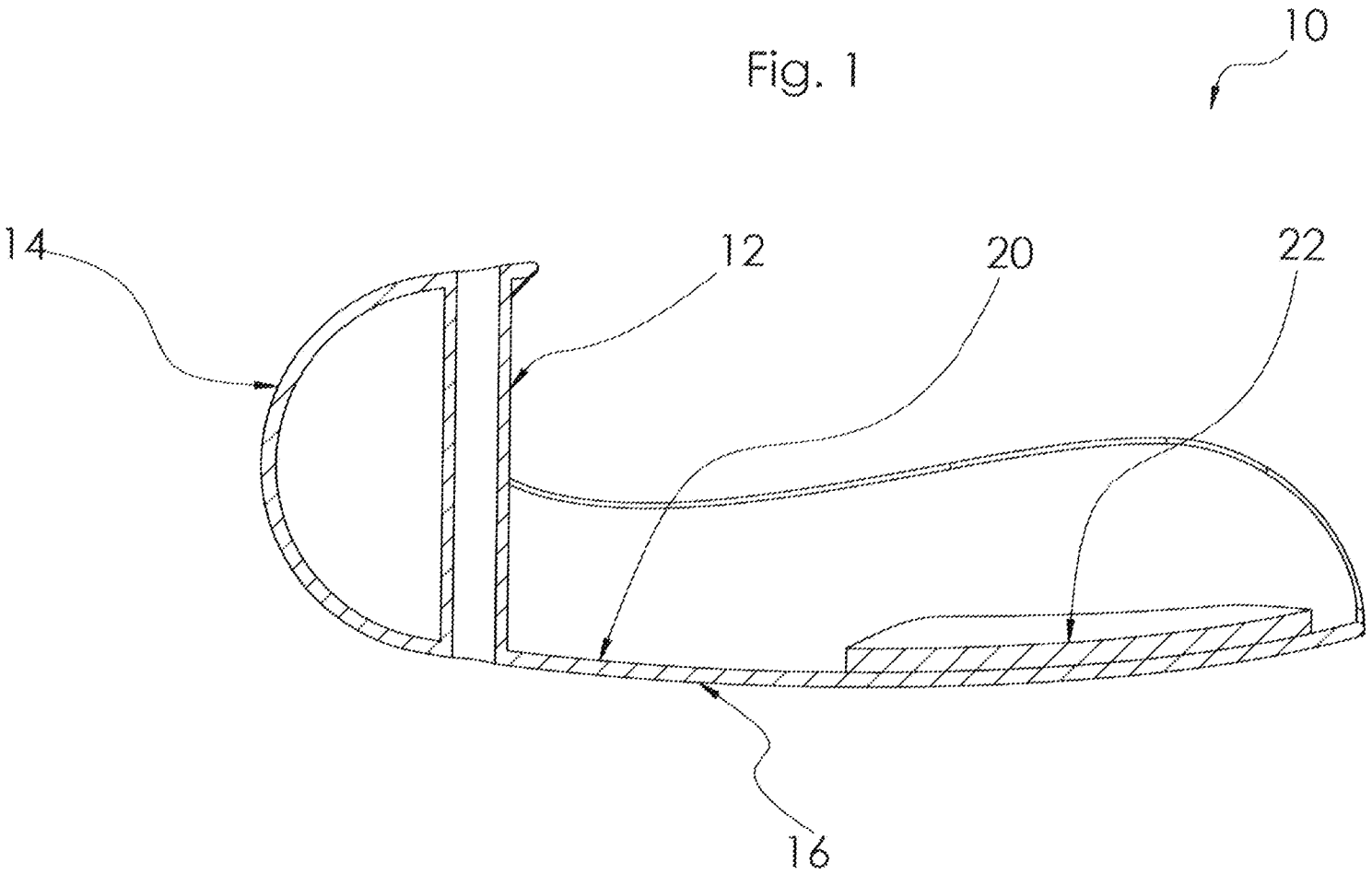
FIG. 1 illustrates a fitness device in accordance with one embodiment.

In one embodiment of the present invention a fitness device 10 is provided as illustrated in FIGS. 1-4. Device 10 can be made of any number of possible materials, for example, wood, metal, polymer and/or a combination of different materials. In one arrangement, device 10 is made of a molded polymer that slides on the exercise surface (floor) and not otherwise causes excessive friction/scratching. In FIGS. 1-4, device 10 is shown alone and in use (FIGS. 2-4 to illustrate one salient exercise transition that can be performed using the present structure). However, the invention is not limited in this respect. Such device 10 can be used for additional exercises (not illustrated) and may be made with some varying shapes and features without deviating from the inventive concepts, for example, as shown in alternative embodiments in FIGS. 5-6 and FIGS. 10-17.

In one embodiment, device 10 is shown as a device for use with a user's hand and forearm; however, it is contemplated that device 10 will be paired with another device 10, one for each arm (forearm) and hand (protected knuckles in, e.g., the high plank position) of the user. Device 10 has a grip handle 12, a curved finger shield region 14, a curved forearm region 16 extending continuous with curved finger region 14, a forearm support 20 and forearm pad 22. Grip handle 12 is generally disposed substantially perpendicular to forearm support 20 although the angle between grip handle 12 and forearm support may be adjusted (or adjustable) to alter the grip comfort or to change the level of difficulty for the exercises.

For example, grip handle 12 is shown for exemplary purposes to be substantially perpendicular to curved forearm region 16, but it is contemplated that in different embodiments, grip handle 12 could also be attached horizontally (180 degrees) or at varying titling angles, titling forwards or sloping backwards with respect to the user, as well as offset angles (+/− degrees from a 90 degree right angle). The grip handle could also be sloped toward the middle or away from the middle. In one embodiment, the grip handle could rotate from the vertical position of the hands to the horizontal position of the hands.

Figure 5:
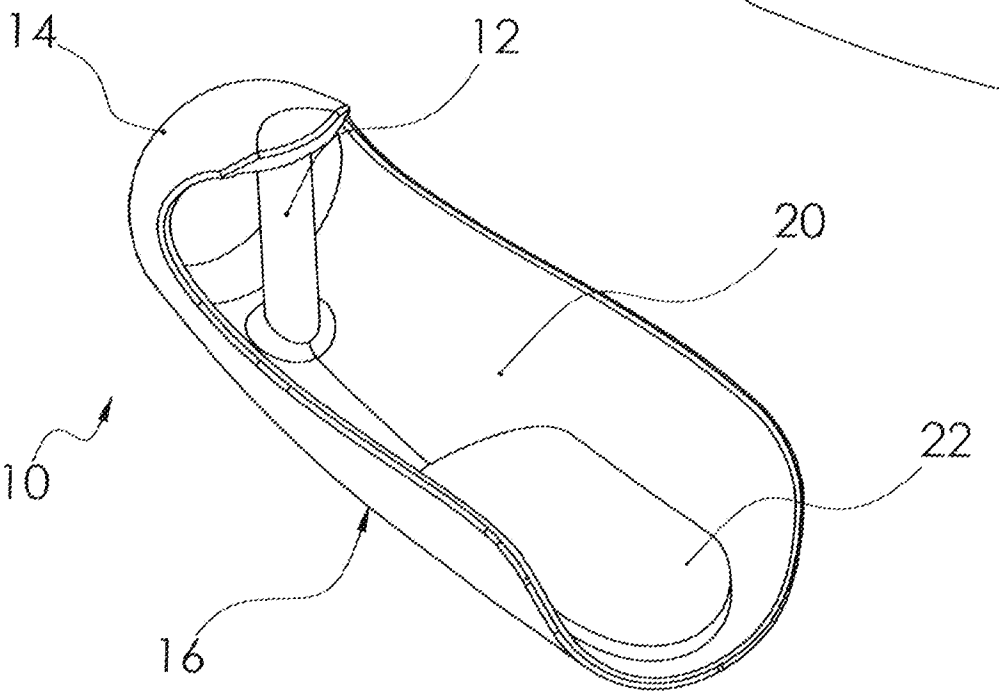

It is also noted that in the present FIG. 1, curved forearm region 16 is shown as separate from the internal straight forearm support 20 but in later embodiments, such pieces can be combined into a single molded element that has one curved outer surface and one flat inner surface as shown for example in FIG. 5. For the purposes of illustration of the function of elements 16 and 20, the embodiment of FIG. 1 shows these elements as separate elements.

FIG. 1 illustrates device 10 in a ready-to-use position for sliding on a supporting surface. It is noted that FIG. 1 is not drawn to any specified scale, but is simply meant to convey the functional shape of device 10. In one embodiment, device 10 may have an attachment element, e.g., a hook and loop strap, that will hold their forearm to forearm support 20 so that they remain securely anchored to the device forming a fusion between the user's forearm and the device 10 (not shown). However, it is noted that such a strap is not integral to device 10 and not required for use.

Figure 2:
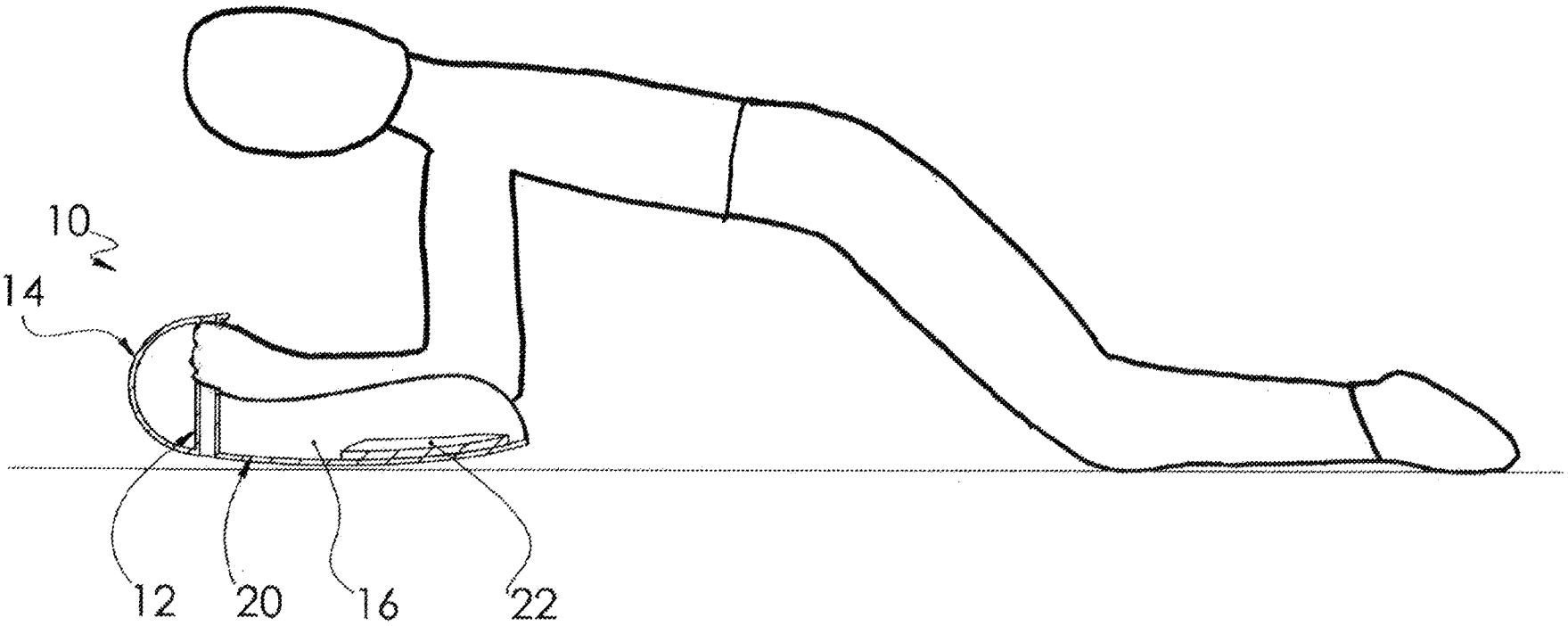
FIG. 2 illustrates the fitness device of FIG. 1, in use, in accordance with one embodiment.

As illustrated in FIG. 2, a user is in the beginning stages before performing an exemplary plank exercise using device 10. As shown, the user holds grip handle 12 and places their forearm on forearm support 20. Curved forearm region 16 rests on the floor. In some embodiments the user's two feet could be either together or moved into an asymmetrical, staggered position. In the drawing, both forearms are parallel to each other in the same position (that is, the arms are in the same symmetrical position with respect to each other and the spacing between the arms could be variable—either closer to each other or farther apart from each other).

Figure 3:
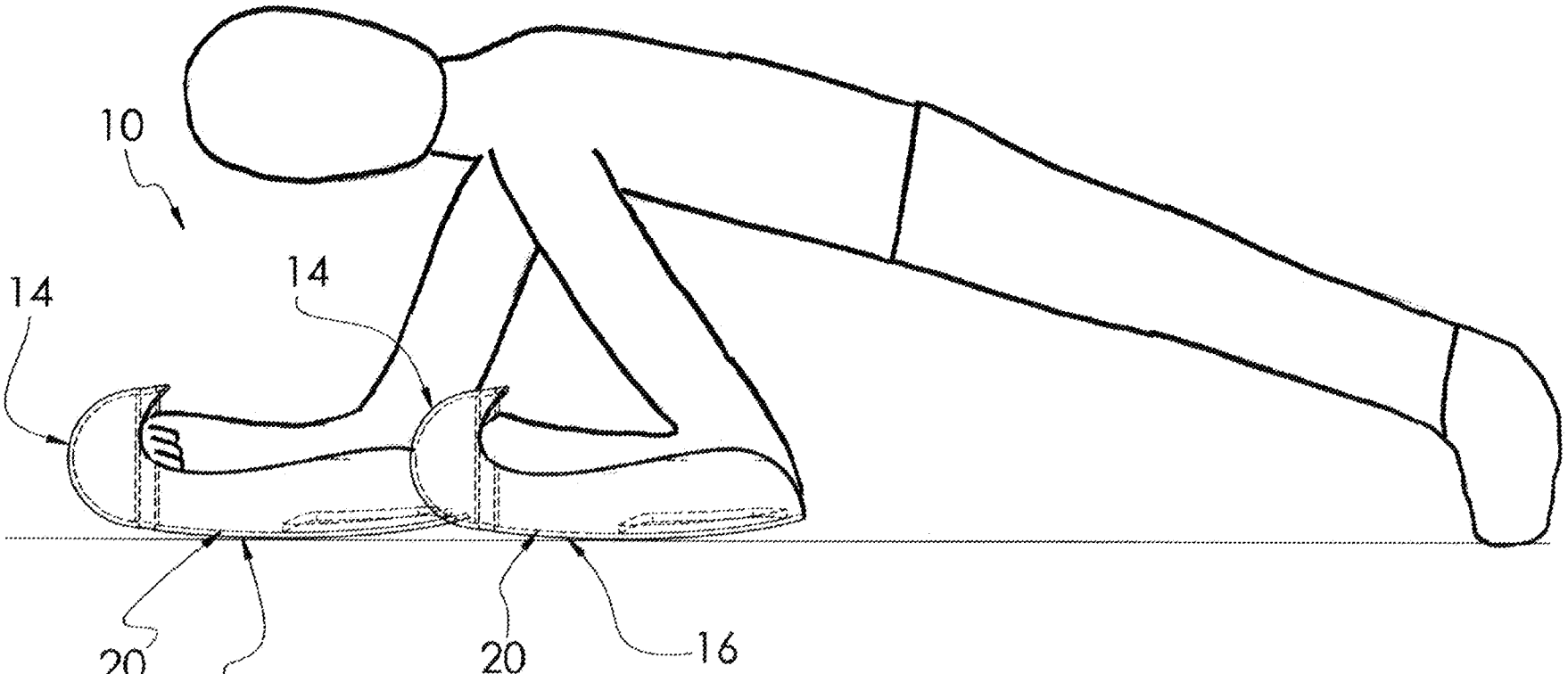
FIG. 3 illustrates the fitness device of FIG. 1, in use, in accordance with one embodiment.

As shown in FIG. 3, the user begins the plank exercise by taking their knees off the ground, using device 10, and now there are only two points of contact with the supporting surface, namely device 10 and either one or two of the user's feet. Here, this is meant to show the situation with the two feet being in the exact same position, but this could vary with each foot being in a staggered position with respect to the other foot; it could vary with one foot being held up off the supporting ground to provide a more challenging exercise position, for example; the variations of positioning for the feet are merely suggested here, and there are a number of positions with which the user could experiment.

It is noted that in FIG. 3 the curved forearm regions 16 of each fitness device 10, are shown in a staggered position with respect to one another. In this example as well, the relative positions of curved forearm region 16 can vary and this drawing is meant to suggest one possibility. Please note that the user in FIG. 3 is in a typical plank exercise position which enhances muscle strengthening. The forearms are resting upon the forearm supports 20 with both elbows bent to encourage full contact with that surface of fitness device 10. Padding 22 on forearm support 20 is available to maximize both the user's comfort and the user's duration for holding this plank exercise position. The different staggered positions shown in FIG. 3 also illustrate possible sliding back and forth action and sliding side to side action which can be so beneficial to the user.

Figure 4:
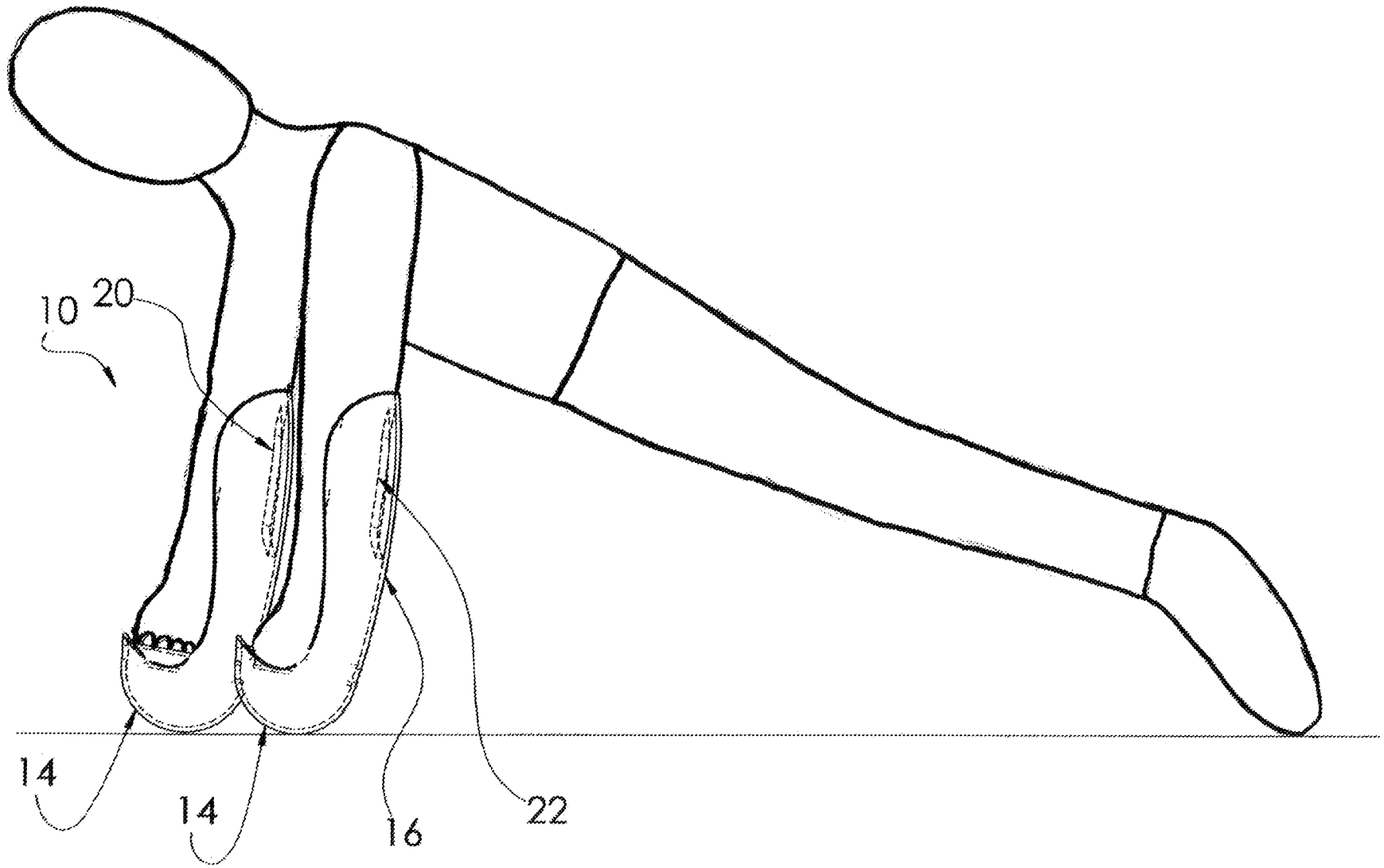
FIG. 4 illustrates the fitness device of FIG. 1, in use, in accordance with one embodiment.
Figure 6:
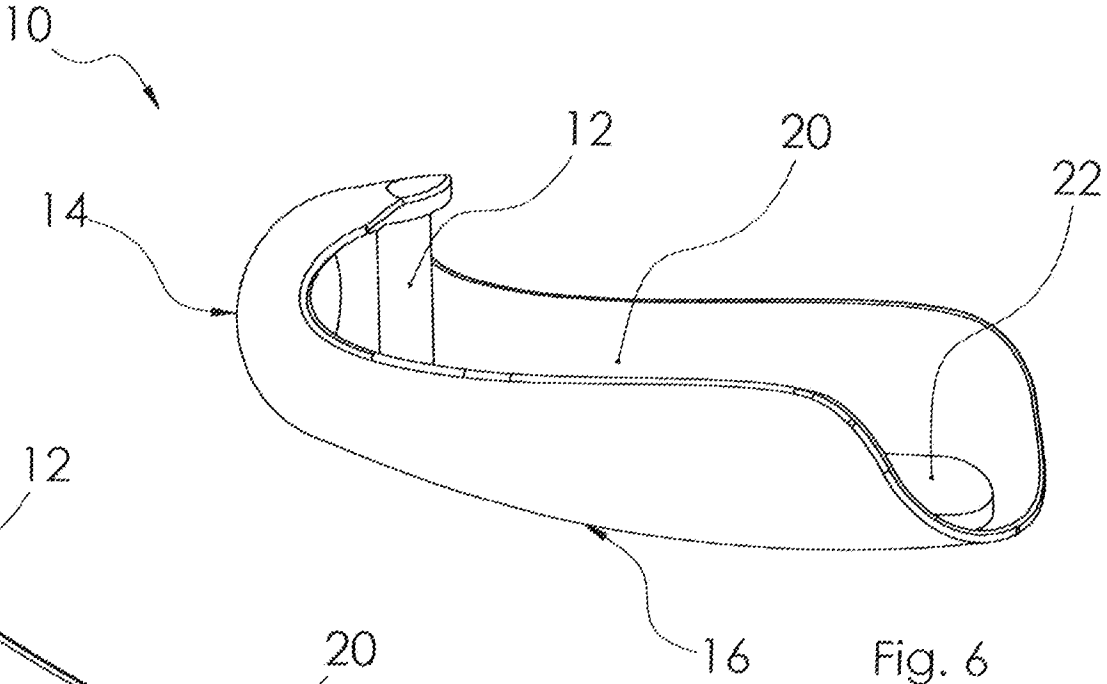
FIGS. 5-6 illustrate a fitness device, in accordance with another embodiment.

Regarding FIG. 4, the user has now moved from the low plank position into having their full outstretched arms (like the top of a push up) pushing against the supporting surface, i.e., the high plank position. As shown, the user's forearms remain against forearm support 20 and the user is still holding grip 12. However, the user, in transitioning from FIG. 3 to FIG. 4, can roll device 10 such that the contact point with the ground is now over the knuckles balancing on curved finger shield region 14. Here there are two points of contact with the supporting surface: 1) both feet of the user where both feet are shown together, that is, not staggered; the distance between the two feet can vary but in each case the two feet will be parallel to each other; and 2) the curved finger portion 14 of device 10.

One feature of device 10 is that the transition from the plank positions shown in FIGS. 3 and 4, i.e., from the low plank position to the high plank position, can be achieved without releasing grip 12. Moreover, devices 10, used one for each arm, are separate from one another, allowing the user even more flexibility regarding relative positioning of their arms. Even further, as noted above, device 10 may be made of a polymer, or other material, that allows for sliding on the floor/support surface for even more possible variations in movement.

Figure 7:
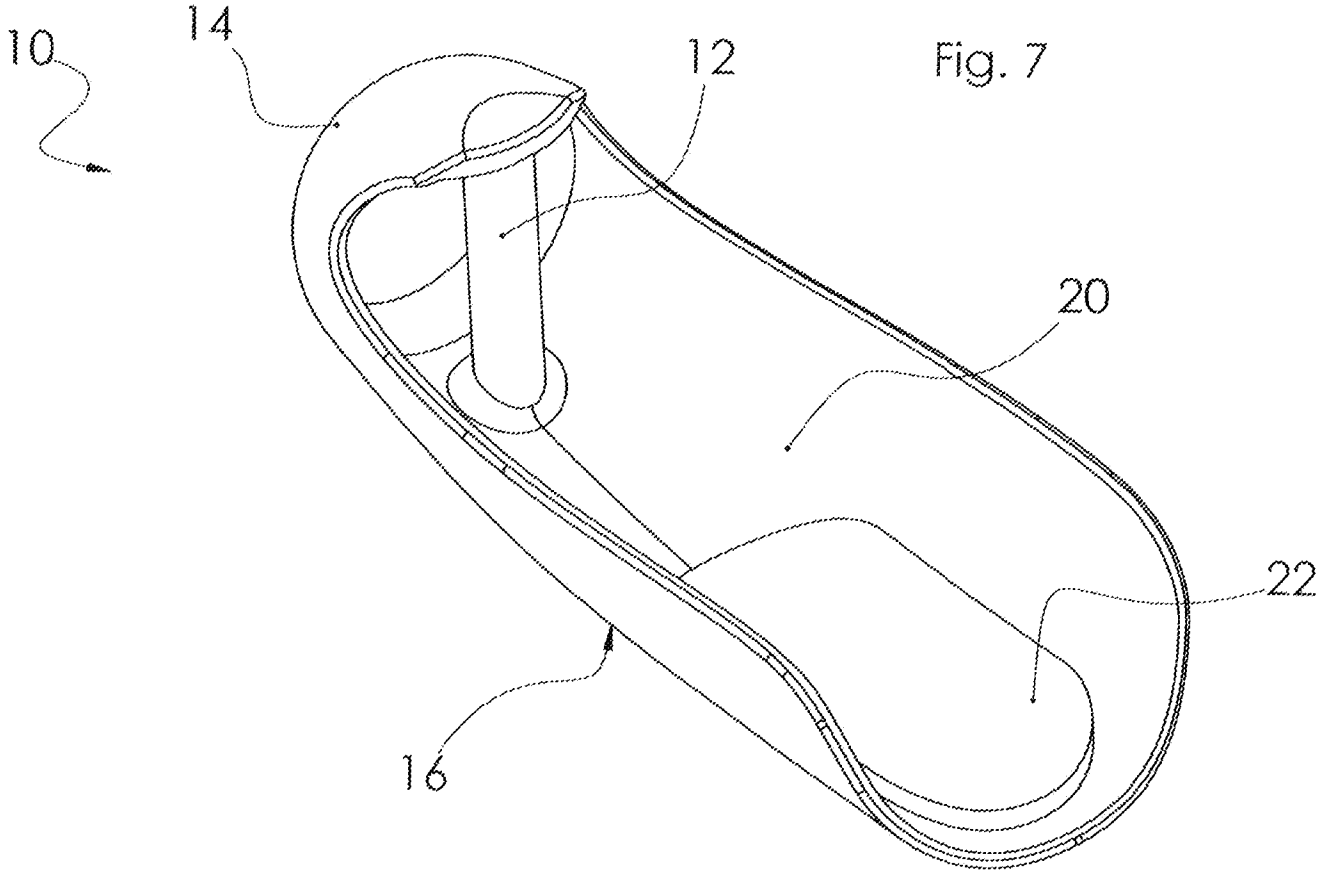
FIGS. 7-9 illustrate particular views of the fitness device of FIGS. 5-6, in accordance with one embodiment.
Figure 9:
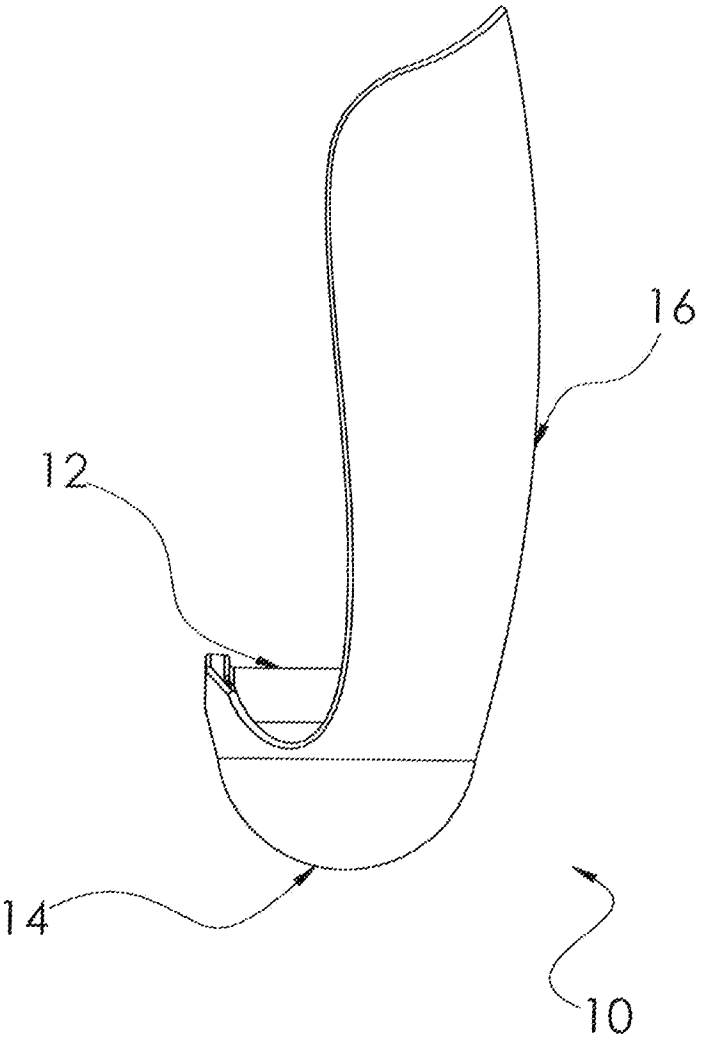
Figure 8:
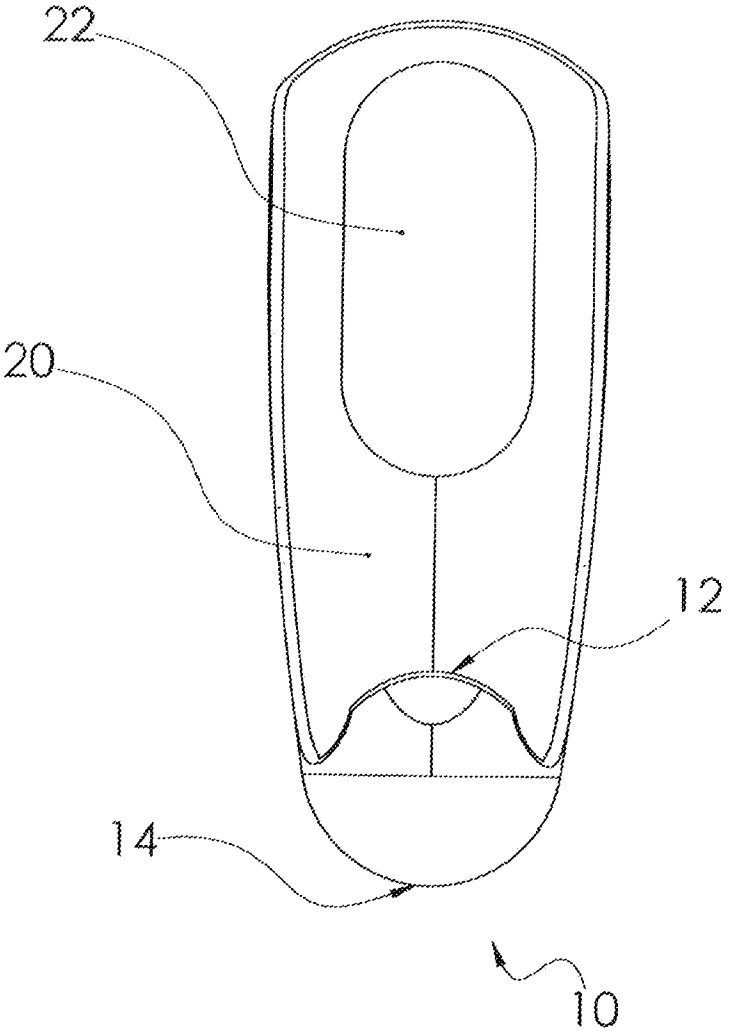
Figure 10:
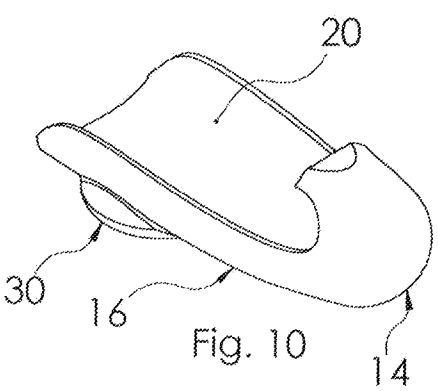
FIGS. 10-18 illustrate a fitness device, in accordance with another embodiment.
Figure 11:
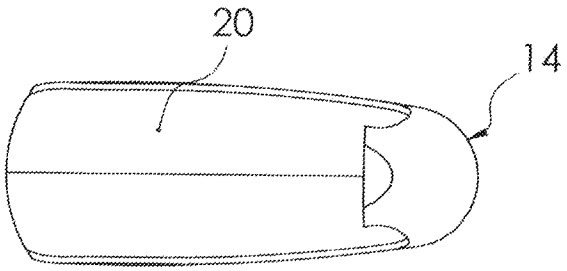
Figure 12:
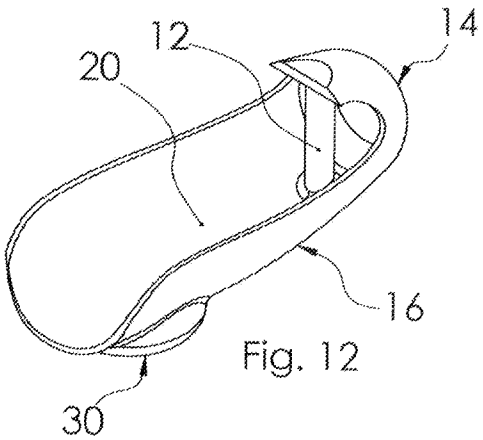
Figure 13:
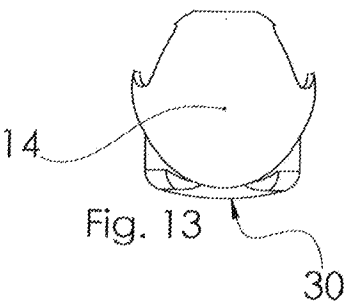
Figure 14:
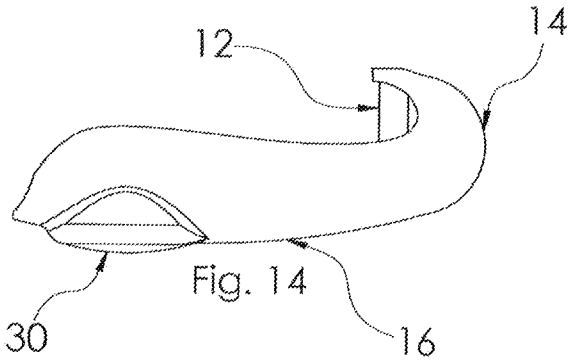
Figure 15:
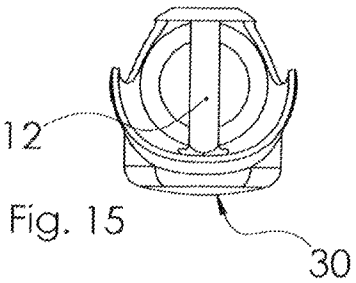
Figure 18:
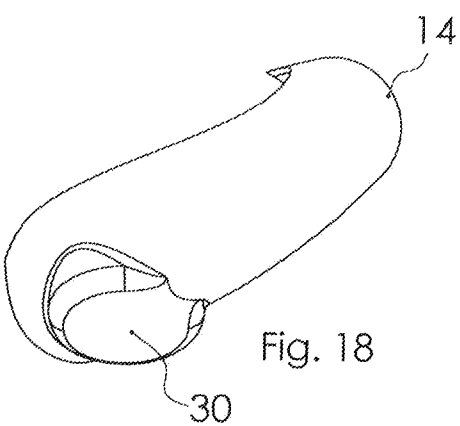
Figure 17:
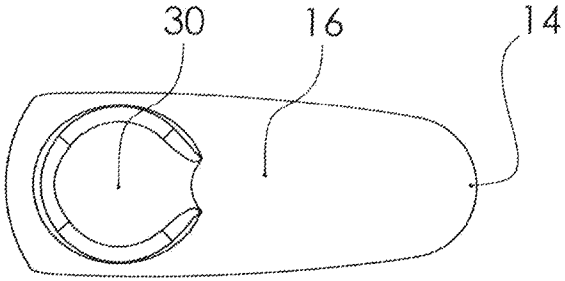
Figure 16:
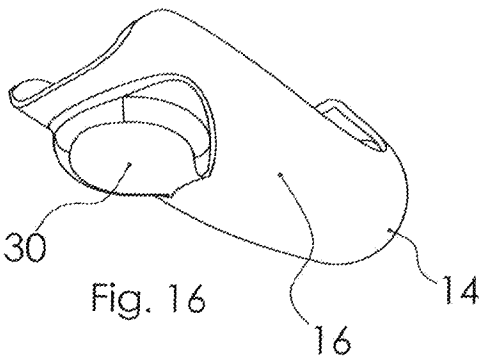

In another embodiment shown in FIGS. 5-9 (FIGS. 7-9 showing dimensions and different views) device 10 is shown in an alternative arrangement. As shown in FIGS. 1-4, forearm support 20 and curved forearm region 16 that contacts the floor are shown as two separate physical elements with a space there between. In the alternative embodiment shown in FIGS. 5-9, device 10 is constructed as a more unified structure and these elements (forearm support 20 and curved forearm region 16) are simply opposing surfaces of a singular element. The forearm support 20 surface is relatively flat and designed for supporting the user's arms and the opposing curved surface forming curved forearm region 16 can be an otherwise a solid single component or a hollow structure, but, as shown in FIGS. 5-9, they are not formed as fully separate elements as in the embodiment of FIGS. 1-4. In other capacities, the device 10 of FIGS. 5-9 essentially functions the same for exercise purposes as the device of FIGS. 1-4.

In another embodiment, FIGS. 10-18 show various views of another embodiment of device 10 with an additional curved balance point 30 near the elbow region on curved forearm region 16 (i.e., bottom surface). The curved balance point 30 could be designed in a variety of ways, e.g., a half sphere, a disc, etc. This curved balance point 30 could be made from a variety of materials. In other respects, device 10 is similar to device 10 of FIGS. 1-4 and FIGS. 5-9.

Figure 19:
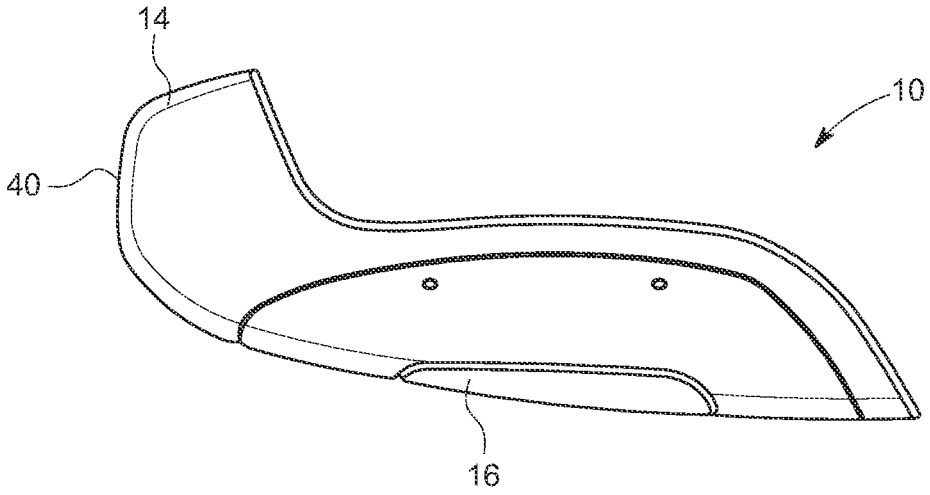
FIGS. 19-20 illustrate a fitness device, in accordance with another embodiment.
Figure 20:
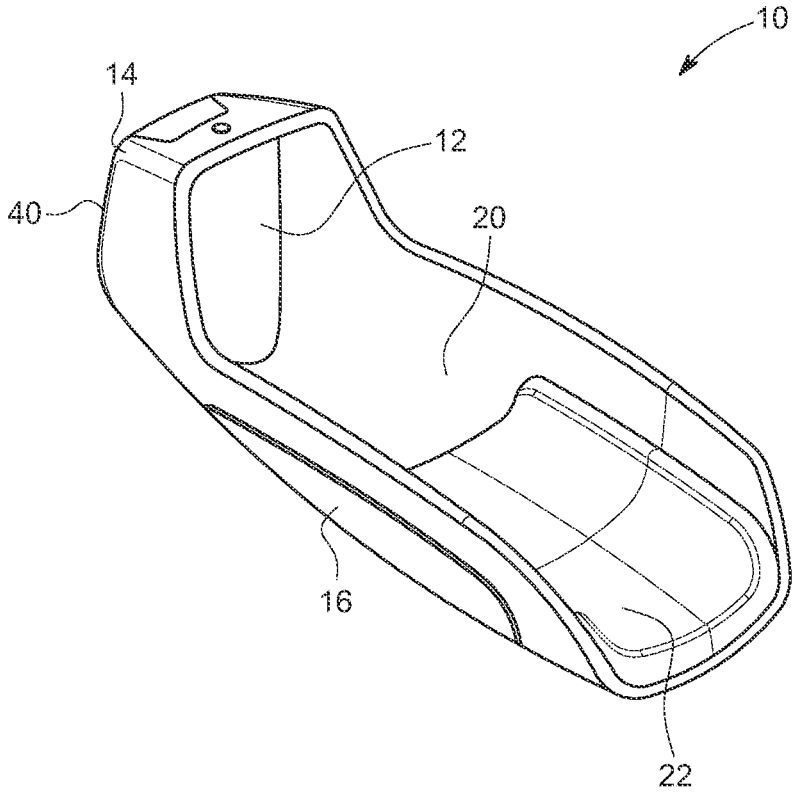
Figure 21:
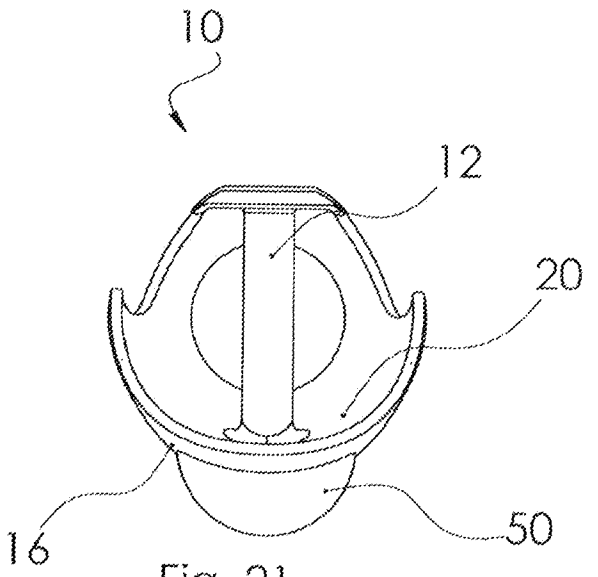
FIGS. 21-24 illustrate a fitness device, in accordance with another embodiment.
Figure 22:
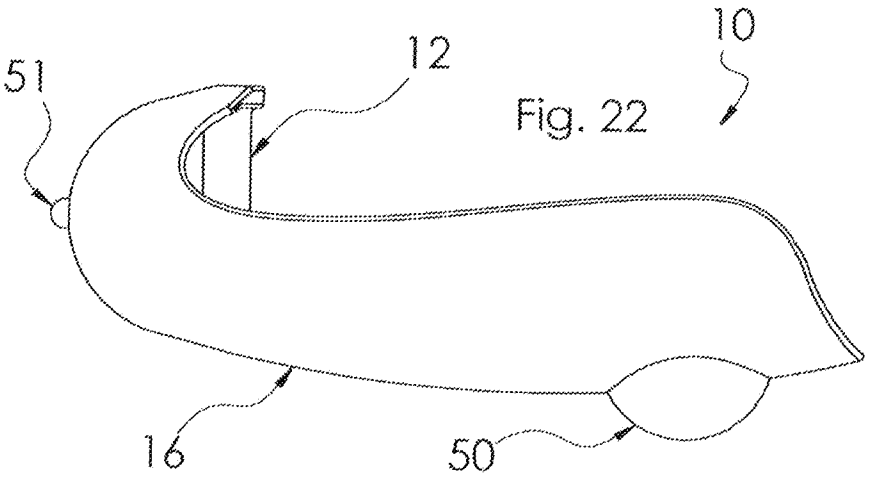
Figure 23:
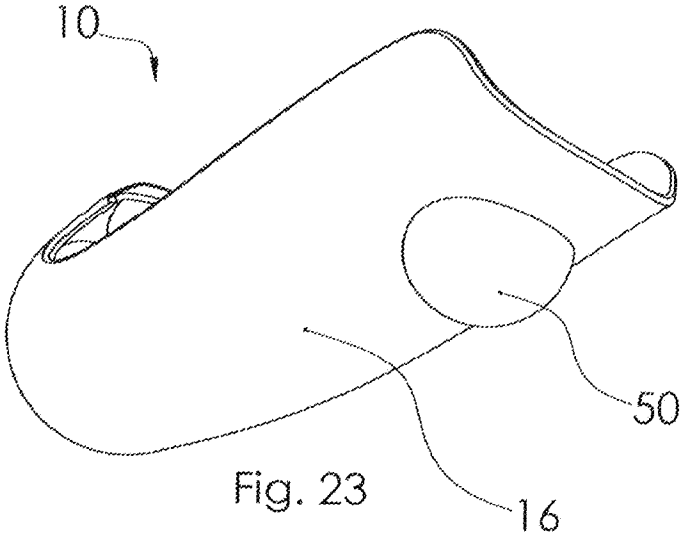
Figure 24:
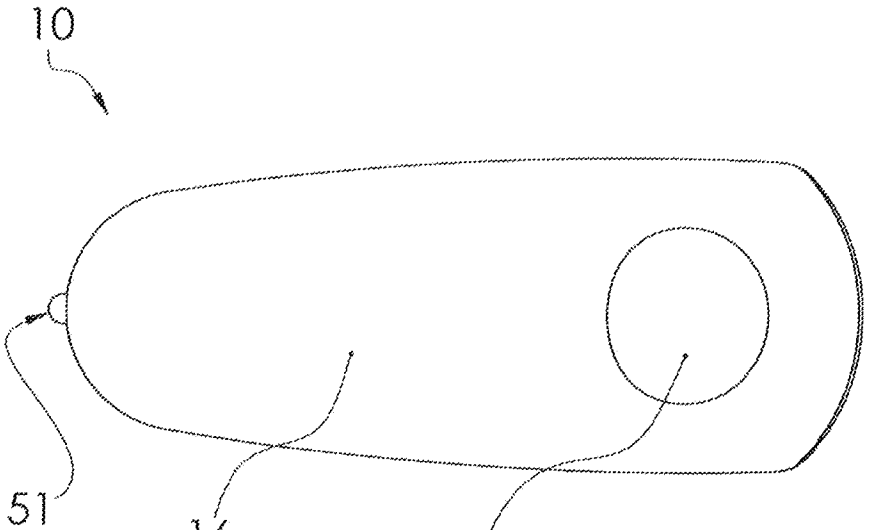
Figure 25:
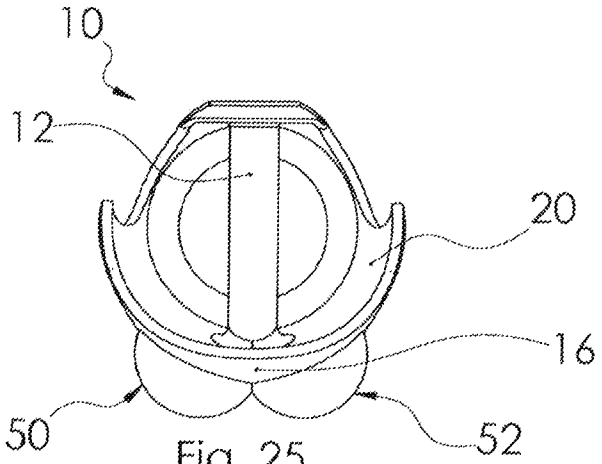
FIGS. 25-28 illustrate a fitness device, in accordance with another embodiment.
Figure 26:
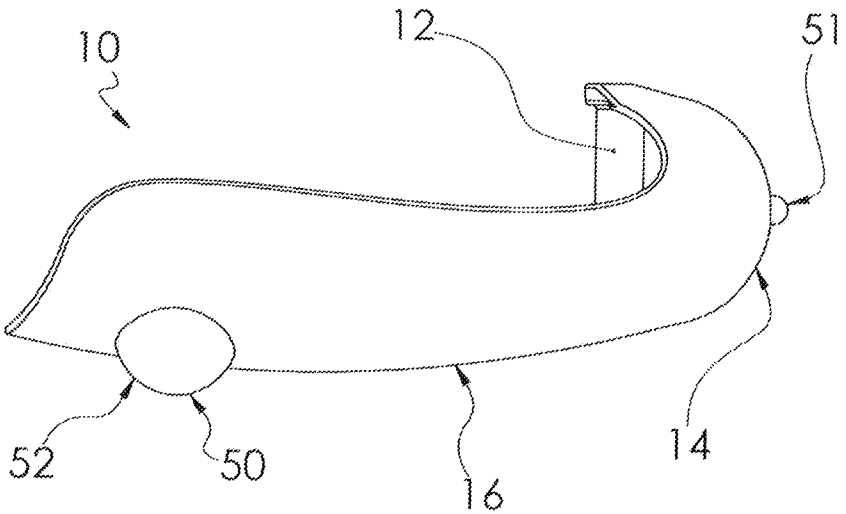
Figure 27:
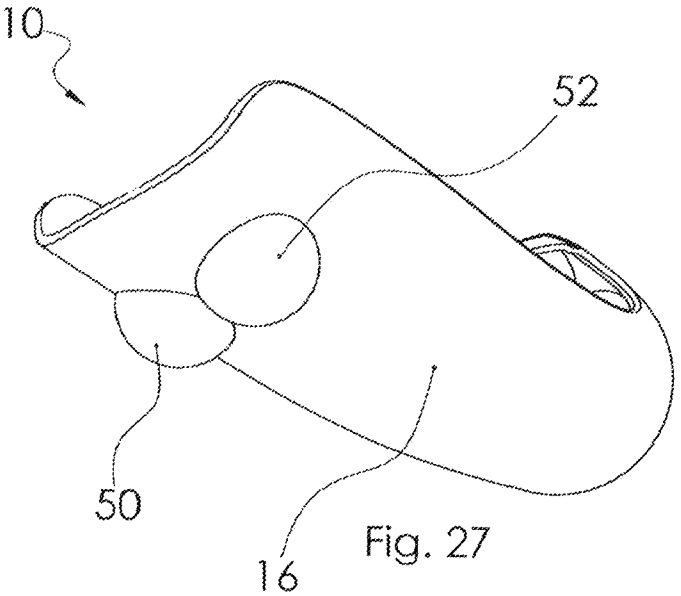
Figure 28:
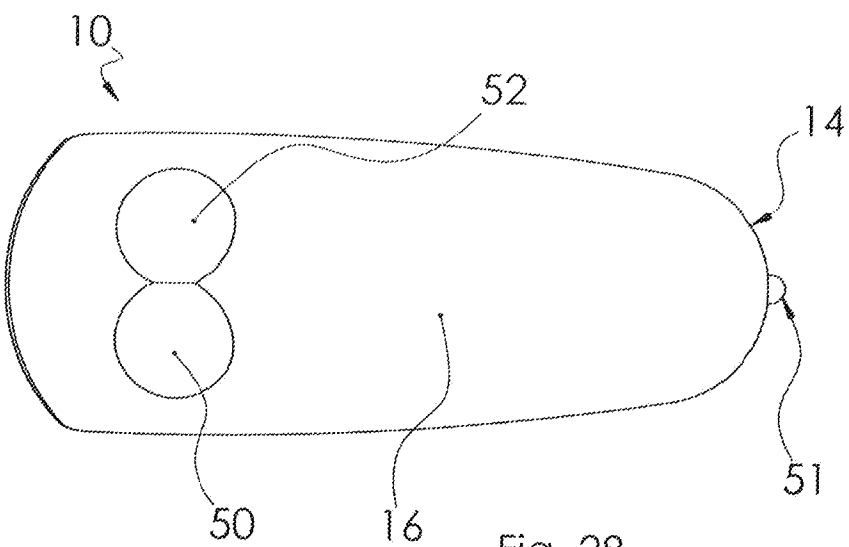

In another embodiment, FIGS. 19-20 show another embodiment of device 10 with an additional flattened nose 40 of the curved finger guard portion 14 for added support during an extended arm plank (FIG. 4). In other respects, device 10 is similar to device 10 of FIGS. 1-4, FIGS. 5-9, and FIGS. 10-18. Such an arrangement as shown in FIGS. 19 and 20 with flattened nose 40 provides an easier solution to achieving a balance between difficulty of an exercise and the safety of the device as it provides a more stable platform when at the top of a high plank exercise (e.g., FIG. 4).

In another embodiment, as shown in FIGS. 21-24, device 10 can be fitted with an omnidirectional rolling caster 50 at either one of the curved forearm regions 16 or curved finger shield regions 14 or both (51 representing an optional second omnidirectional caster located on said curved finger shield region 14). This arrangement is similar to the arrangement in FIGS. 10-18 except that the curved balance point 30 is replaced with omnidirectional rolling caster 50, providing a user with a wider range of flexibility to engage in additional flexion and movements when at the high plank position (FIG. 4) or at the low plank position (FIG. 3). FIGS. 25-28 are similar to the arrangement in FIGS. 21-24 except that the curved forearm region 16 has two (2) omnidirectional rolling casters 50, 52 arranged perpendicular to the axis of curved forearm region 16 to provide a more stable, and easier to manage, support connection than the embodiment in FIGS. 21-24.

Figure 29:
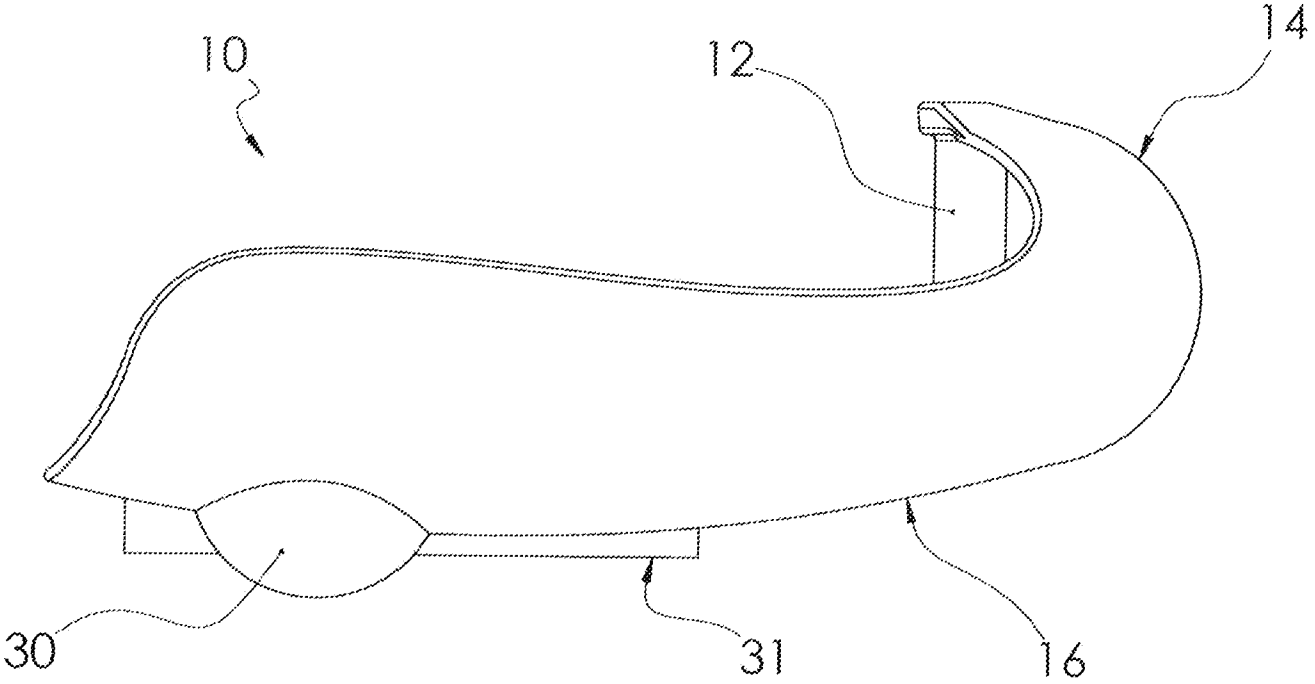
FIG. 29 illustrates a fitness device, in accordance with another embodiment.

In another embodiment, similar to the embodiments in FIGS. 10-18, device 10 shown in FIG. 29 likewise includes a curved balance point 30 on curved forearm region 16 which provides additional challenges to a user's balance. As mentioned above, this curved balance point 30 can be made from a variety of materials. In this arrangement, curved balance point 30 is adjustable forwards and backwards (relative to grip handle 12) within a balance point track 31. Such an arrangement allows a user to adjust balance point 30 to accommodate users of varied body size. Such a balance point track may include either one of free movement (sliding during an exercise) or could include distinct stopping points so that a user may set an ideal location for their body type/size.

Figure 30:
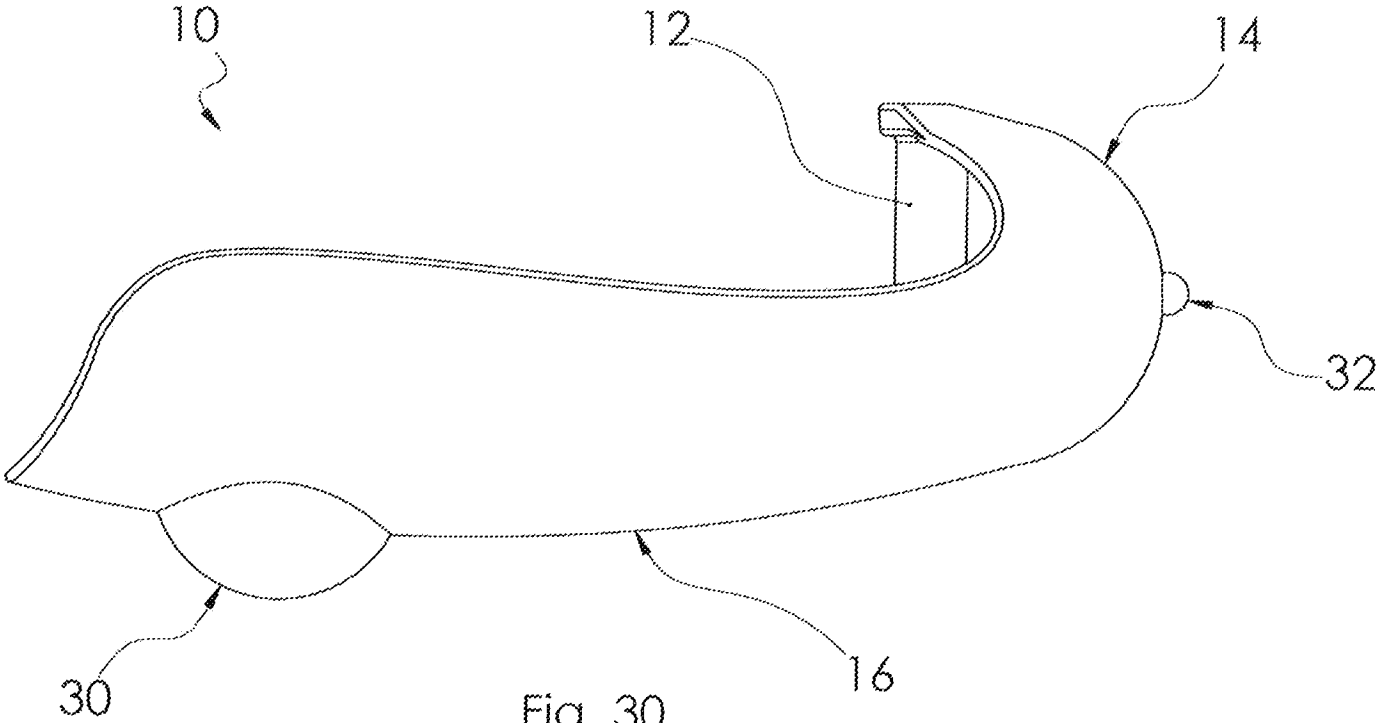
FIG. 30 illustrates a fitness device, in accordance with another embodiment.
Figures 31A, 31B, 31C, 31D, 31E, 31F, 31G, 31H, 31I:
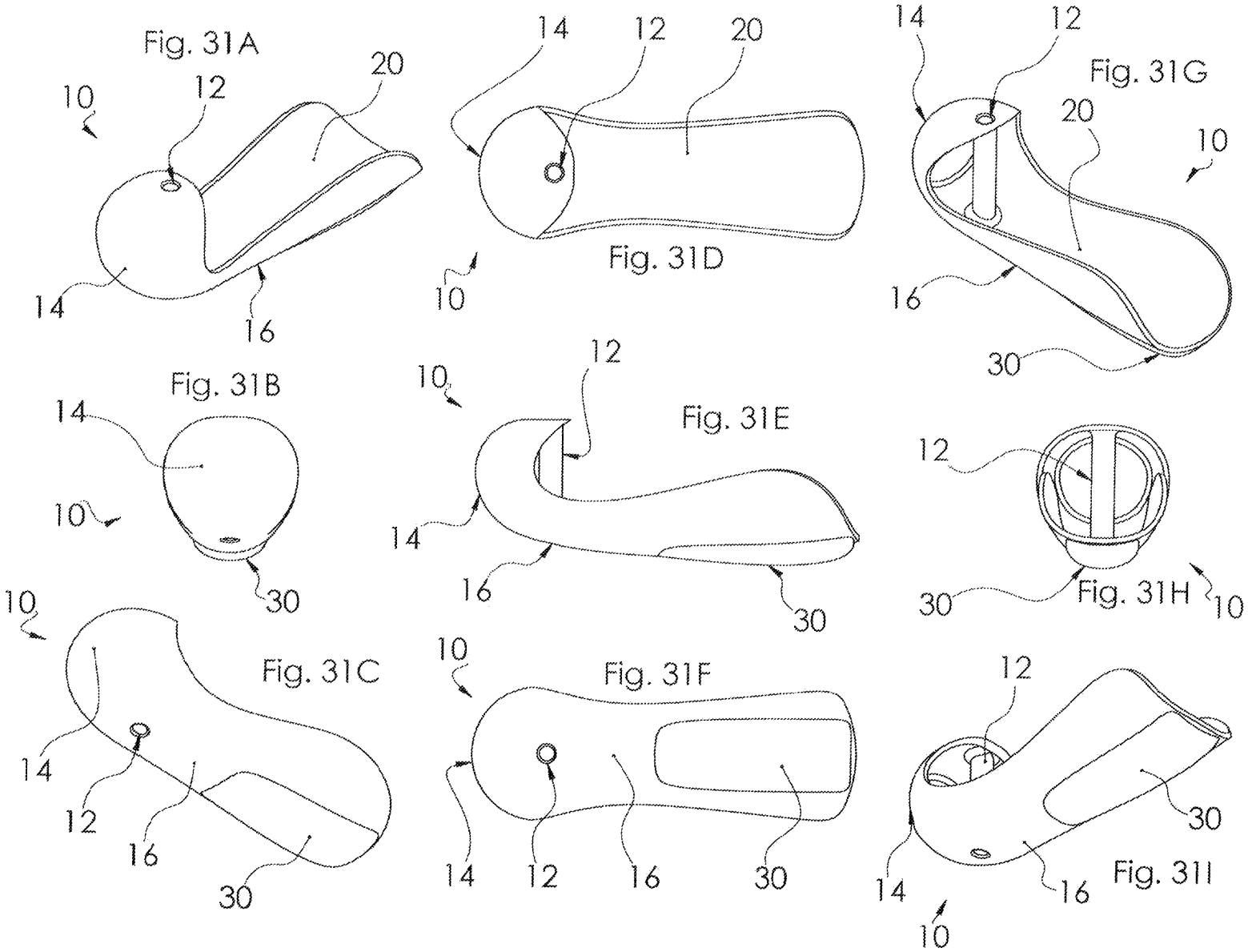
FIGS. 31A-31I illustrate a fitness device, in accordance with another embodiment.

In another embodiment shown in FIG. 30, device 10 may include a sharply defined curved or rounded point 32 on the tip of curved finger shield region 14. In this arrangement, point 32 is a fixed polymer (as one example of a material that could be used) nub, unlike the rolling caster option 50 discussed above in connection with embodiments of FIGS. 21-28. This added point is another way for device 10 to include features that increase the difficulty of performing push-ups and high plank exercises for the user when using device 10.

In another embodiment illustrated in FIGS. 31A-31I, device 10 is shown in nine images (A-I) representing different angles or views of the fitness device. In the embodiment of FIGS. 31A-I, grip handle 12 is hollow, curved finger shield region 14 has an oval shape/profile, and curved balance point 30 on the bottom of forearm region 16 is rectangular in shape with curved edges.

Figure 32A:
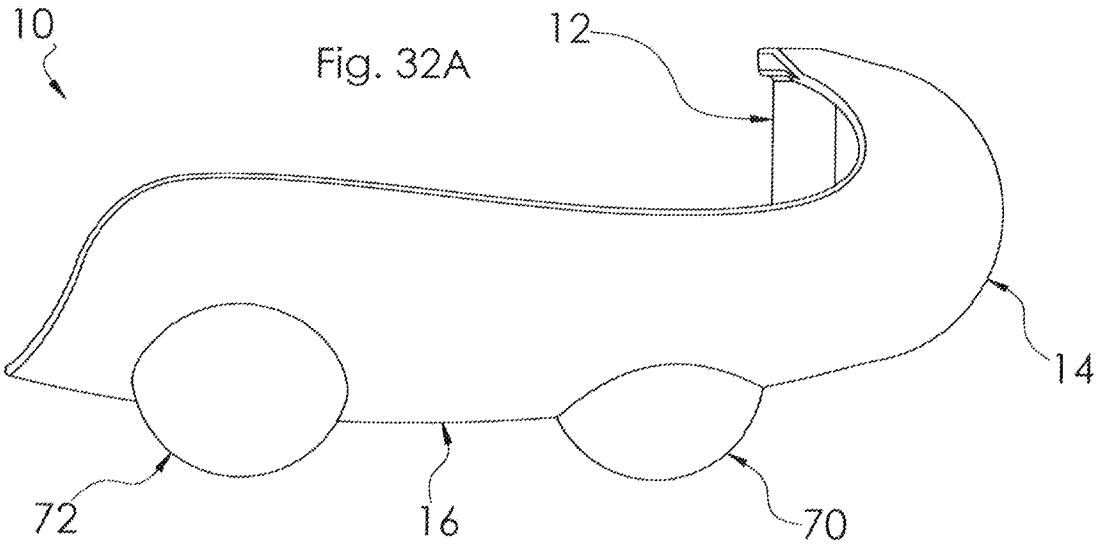
FIGS. 32A-32B illustrate a fitness device, in accordance with another embodiment.
Figure 32B:
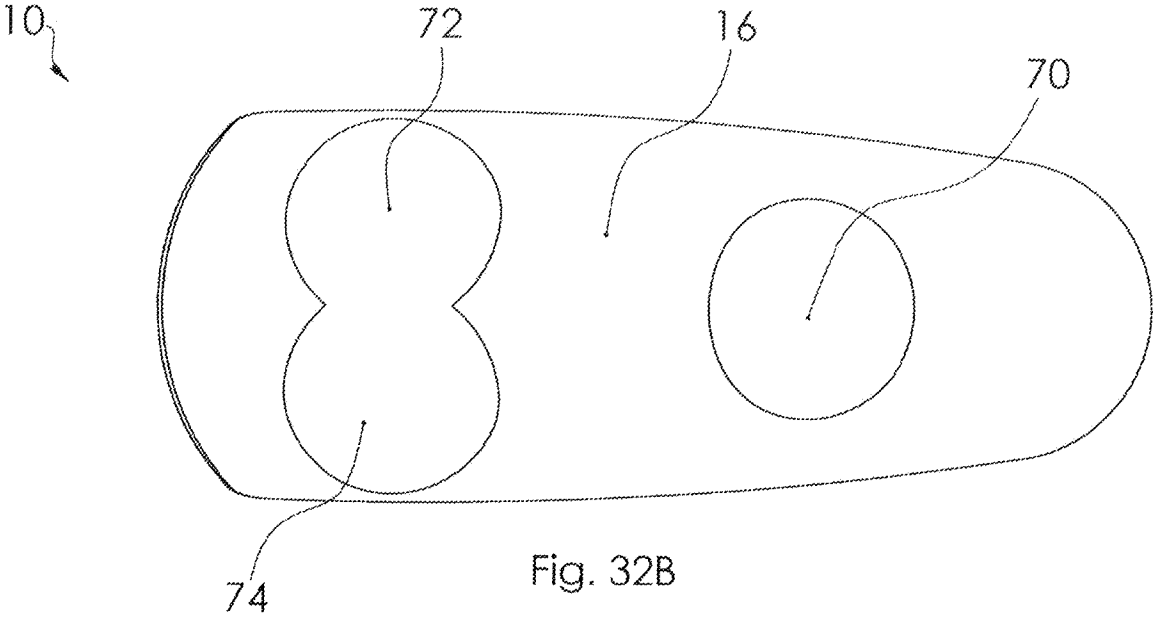

In another embodiment, as shown in FIGS. 32A and 32B, device 10 can be fitted with omnidirectional rolling casters 70, 72, and 74 on curved forearm region 16. This arrangement is similar to the arrangement in FIGS. 21-24 except that the triangularly arranged casters 70, 72, and 74 provide a user with a more stable base when in the low plank position (relative to single caster or curved balance point options) and provide an additional range of exercises including lateral movements while in the low plank position.

Because on the need to provide more ideal contact between the three omnidirectional rolling casters (70, 72, and 74) and the supporting surface, a different embodiment of device 10 could include a relatively flattened bottom surface of the forearm region 16 (eliminating the curved shape on the bottom as needed).

What is claimed is:

1. An exercise device for use in connection with at least one bodyweight exercise, said exercise device comprising:

a grip handle;

a forearm support extending from said grip handle, configured to allow a user to grasp the grip handle and simultaneously to support a forearm thereon;

a curved finger shield region covering said grip handle; and a curved forearm region covering said forearm support, wherein said curved finger shield region and said curved forearm region form a contiguous curved surface with a substantially perpendicular transition between the two, configured such that said user grasping the grip handle and simultaneously placing their forearm on said forearm support is capable of supporting at least a portion of their body weight on either one of said curved finger shield region or said curved forearm region, and wherein said curved forearm region includes one or more omnidirectional casters.

2. The exercise device as claimed in claim 1, wherein said exercise device is formed from a polymer, or other material.

3. The exercise device as claimed in claim 2, wherein said exercise device is formed as an integrally molded unit, including said curved finger shield region, said grip handle, said curved forearm region, and said forearm support.

4. The exercise device as claimed in claim 3, wherein said curved forearm region and said forearm support are formed as sides of a single physical component.

5. The exercise device as claimed in claim 4, wherein said exercise device is configured to allow for unique sliding low plank exercises on the curved forearm region of the exercise device that involves one or both arms of said user.

6. The exercise device as claimed in claim 1, wherein said exercise device is configured to allow said user to perform either one of two plank exercises, such that said user is capable of contacting the curved forearm region against a floor when in a low plank position, and where said user is capable of contacting the curved finger shield region against said floor when in a high plank position.

7. The exercise device as claimed in claim 6, wherein said exercise device is configured to allow said user to transition from said user contacting the curved forearm region against said floor when in said low plank position to said user contacting the curved finger shield region against said floor when in said high plank position in rolling transition contacting said contiguous curved surface, between said curved finger shield region and said curved forearm region.

8. The exercise device as claimed in claim 1, wherein the one or more omnidirectional casters comprises at least two omnidirectional casters, wherein one of said at least two omnidirectional casters is disposed perpendicular to a long axis of said curved forearm region.

9. The exercise device as claimed in claim 8, wherein said at least two omnidirectional casters comprises three omnidirectional casters attached to a bottom of the curved forearm region, said three omnidirectional casters arranged in a triangle.

10. The exercise device as claimed in claim 1, wherein said grip handle is arranged substantially perpendicular to said forearm support.

11. The exercise device as claimed in claim 10, wherein said grip handle is offset from perpendicular between 0 and 90 degrees, such that said grip handle is configured to slope towards or away from the user.

12. The exercise device as claimed in claim 10, wherein said grip handle is arranged substantially horizontal to, and perpendicular to, said forearm support.

13. The exercise device as claimed in claim 1, wherein said forearm support includes a forearm pad.

14. The exercise device as claimed in claim 1, wherein said curved finger shield region has a quasi-curved surface including a flattened nose.

15. The exercise device as claimed in claim 1, wherein said curved forearm region includes a curved balance point.

16. The exercise device as claimed in claim 1, wherein said curved finger shield region includes a separate omnidirectional caster from said one or more omnidirectional casters on said curved forearm region.

17. The exercise device as claimed in claim 1, wherein said curved finger shield region includes a sharply defined curved or rounded point placed at a tip of said curved finger shield region.

* * * * *